US009341361B2

(12) United States Patent
Diekmann et al.

(10) Patent No.: US 9,341,361 B2
(45) Date of Patent: May 17, 2016

(54) LIGHT-EMITTING MEANS AND USE

(75) Inventors: Karsten Diekmann, Rattenberg (DE); Steven Rossbach, Adorf (DE); Britta Göötz, Regensburg (DE); Kok Eng Ng, Ayer Itam (MY); Sok Gek Beh, Gelugor (MY); Mardiana Binti Khalid, Balik Pulau (MY); Boon Liang Yap, Air Itam (MY); Shahrol Izzanni Abdul Manaf, Penang (MY)

(73) Assignee: OSRAM Opto Semiconductors GmbH (DE)

( * ) Notice: Subject to any disclaimer, the term of this patent is extended or adjusted under 35 U.S.C. 154(b) by 49 days.

(21) Appl. No.: 14/241,716

(22) PCT Filed: Aug. 6, 2012

(86) PCT No.: PCT/EP2012/065369

§ 371 (c)(1),
(2), (4) Date: Jun. 2, 2014

(87) PCT Pub. No.: WO2013/034381

PCT Pub. Date: Mar. 14, 2013

(65) Prior Publication Data

US 2014/0293604 A1 Oct. 2, 2014

(30) Foreign Application Priority Data

Sep. 6, 2011 (DE) ..... 10 2011 082 209

(51) Int. Cl.
*F21V 23/06* (2006.01)
*F21V 15/01* (2006.01)

(Continued)

(52) U.S. Cl.
CPC ..... *F21V 23/06* (2013.01); *F21V 15/01* (2013.01); *F21V 17/105* (2013.01); *F21V 21/002* (2013.01); *F21V 21/30* (2013.01); *F21K 9/30* (2013.01); *F21V 29/004* (2013.01); *F21Y 2105/008* (2013.01)

(58) Field of Classification Search
CPC ..... F21V 15/01; F21V 21/30; F21V 23/06; F21V 21/002; F21V 17/105; F21K 9/30; F21Y 2105/008
USPC ..... 362/398
See application file for complete search history.

(56) References Cited

U.S. PATENT DOCUMENTS 7,997,774 B2 * 8/2011 Liddle ..... 362/398
2006/0132031 A1 6/2006 Chang et al.

(Continued)

FOREIGN PATENT DOCUMENTS

DE 20 2010 008 324 1/2011
DE 102010014307 10/2011

(Continued)

OTHER PUBLICATIONS

English translation of a Korean Office Action dated Jul. 13, 2015 from corresponding Korean Patent Application No. 10-2014-7009142.

*Primary Examiner* — Y M Lee
(74) *Attorney, Agent, or Firm* — DLA Piper LLP (US)

(57) ABSTRACT

A light emitter with a radiation exit surface including a housing part with a receptacle, at least one organic optoelectronic device, arranged in the receptacle, and at least one cover part joined to the housing part, wherein the device is mounted between the cover part and the housing part.

16 Claims, 9 Drawing Sheets

(51) Int. Cl.

| | |
|---|---|
| ***F21V 17/10*** | (2006.01) |
| ***F21V 21/002*** | (2006.01) |
| ***F21V 21/30*** | (2006.01) |
| *F21V 29/00* | (2015.01) |
| *F21K 99/00* | (2016.01) |
| *F21Y 105/00* | (2016.01) |

(56) References Cited

U.S. PATENT DOCUMENTS

| | | | | |
|---|---|---|---|---|
| 2010/0157585 | A1 | 6/2010 | Diekmann et al. | |
| 2011/0181494 | A1 | 7/2011 | Wong et al. | |
| 2011/0260598 | A1 * | 10/2011 | Liu | F21K 9/30 313/46 |
| 2012/0039075 | A1 | 2/2012 | Hofmann et al. | |
| 2012/0293997 | A1 * | 11/2012 | Zaderej | 362/235 |
| 2013/0044501 | A1 * | 2/2013 | Rudisill et al. | 362/398 |
| 2013/0201683 | A1 | 8/2013 | Kirchberger | |

FOREIGN PATENT DOCUMENTS

| | | |
|---|---|---|
| DE | 102010038252 | 4/2012 |
| EP | 1 367 675 | 12/2003 |
| EP | 2 241 797 | 10/2010 |
| KR | 20-0320726 | 7/2003 |
| KR | 20-0378270 | 3/2005 |
| KR | 10-0970504 | 7/2010 |
| WO | 2010/116301 | 10/2010 |
| WO | 2011/067093 | 6/2011 |
| WO | 2012/052441 | 4/2012 |

* cited by examiner

LIGHT-EMITTING MEANS AND USE

TECHNICAL FIELD

This disclosure relates to a light emitter and use of an element for a light emitter.

BACKGROUND

Light emitters are very significant, especially in the context of general lighting, for example, to equip luminaires such as lamps, with a light emitter as the radiation-generating element.

It could therefore be helpful to provide a novel light emitter, in particular an improved light emitter, as well as an element for a light emitter that offers particular advantages when used in the light emitter.

SUMMARY

We provide a light emitter with a radiation exit surface comprising a housing part with a receptacle, at least one organic optoelectronic device arranged in the receptacle, and at least one cover part joined to the housing part, wherein the device is mounted between the cover part and the housing part.

We also provide a light emitter with a radiation exit surface comprising a housing part with a receptacle, at least one organic optoelectronic device arranged in the receptacle, at least one cover part joined to the housing part, wherein the device is mounted between the cover part and the housing part, and one or more external electrical terminal parts, wherein the device comprises a plurality of electrical contacts of the same polarity, the contacts of the same polarity connects via a connecting conductor of a conductor part to a common external electrical terminal part, and the conductor part is a flexible printed circuit board.

DETAILED DESCRIPTION

Figure 1:
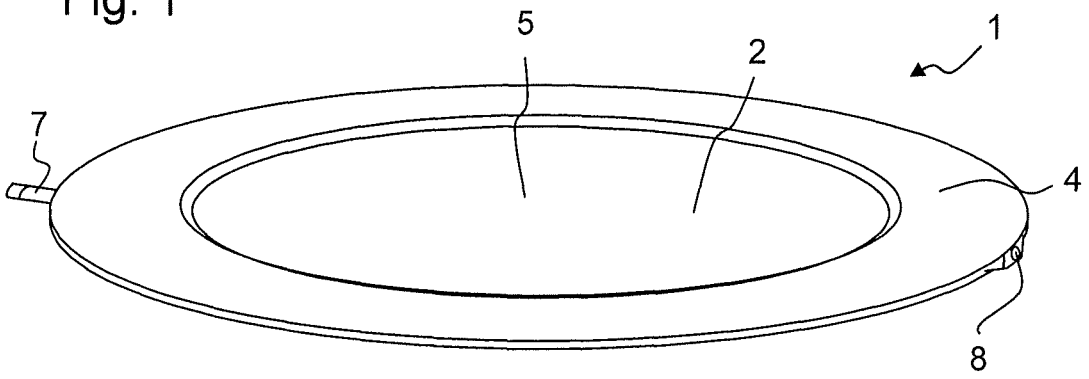
FIGS. 1 and 2 show different schematic oblique views of a light emitter according to a first example.

The light emitter may be provided with a radiation exit surface. Radiation, preferably visible radiation, generated in the light emitter may leave the light emitter through the radiation exit surface.

The light emitter may comprise a housing part. The housing part may comprise a receptacle. A radiation-generating element for the light emitter may be arranged in the receptacle. The receptacle may be defined, in particular surrounded, by a rim. The housing part may advantageously protect internal elements of the light emitter such as, for instance, electrical contacts of the radiation-generating element, from harmful external influences. The housing part may form at least part of the outer surface of the light emitter.

The light emitter may comprise a cover part. The cover part is preferably joined, for example, detachably or nondetachably, to the housing part. The cover part may form at least part of the outer surface of the light emitter.

The light emitter may comprise a radiation-emitting or optoelectronic device, which conveniently generates radiation. The device may be shaped like a tile. The device may be an organic device such as, for example, an organic luminescent diode (OLED). The organic device preferably comprises organic functional material which, when supplied appropriately with electrical power, generates electromagnetic radiation, preferably in the visible spectral range. The device may comprise a radiation exit surface. This may form the radiation exit surface of the light emitter. The radiation exit surface of the device may thus form an outer surface of the emitter.

The device may be arranged in the receptacle of the housing part. The device may be inserted into the receptacle. The receptacle of the housing part may be shaped in accordance with the device. The receptacle may be shaped such that, when the device is arranged in the receptacle, relative motion, in particular relative rotation, between housing part and device is limited or prevented. This may be achieved by suitable shaping of the receptacle to match the shaping of the device, for example, by corresponding corners in a rim delimiting the receptacle.

The device may be mounted between the cover and the housing parts. If the cover part is joined to the housing part, a retaining space may be formed between the cover part and the housing part, in which space a part of the device may be arranged. A retaining groove may, for example, be configured as a retaining space between the housing and the cover parts. The retaining space may extend around the entire circumference of the device. If the cover part is joined detachably to the housing part, the cover part may be removed from the housing part and the device optionally removed from the housing part. A defective device is thus simple to replace.

The cover part may cover electrical and/or mechanical elements such as fastenings or electrical leads, of the light emitter that might lie exposed in the receptacle. The covered elements are thus protected from harmful external influences, for instance mechanical loading. Electrical and mechanical elements are often not very aesthetically appealing. The cover part thus increases the aesthetic appeal of the light emitter. The cover part may cover the entire receptacle apart from the radiation exit surface of the device and, preferably, may even cover a rim of the housing part extending unevenly around the receptacle. On the outside, the cover part may terminate flush with the housing part.

The light emitter may have a maximum thickness of 8 mm or less. Mounting the device holder between the cover and housing parts makes it possible to provide a particularly shallow light emitter. The light emitter may in particular be of a thickness which is a quarter or less, preferably a fifth or less, for instance a sixth or less of a lateral dimension, for example, the diameter of the radiation exit surface of the light emitter. The light emitter may accordingly take the form of a flat light emitter.

The cover part preferably has a cut-out in a radiation passage region. The cover part may thus be selected irrespective of its optical properties in terms of the radiation generated in the light emitter. In the radiation passage region radiation may pass unimpeded through the cover part. The cover part may comprise a central cut-out. The cover part may be annular in plan view.

The housing part may have a cut-out. The housing part may have a cut-out in the region of the receptacle. The housing part conveniently has a cut-out in a region that overlaps the radiation passage region of the cover part, or is even covered, in particular completely, thereby. If both the housing part and the cover part have cut-outs, a cut-out may be visible both from the front of the light emitter with the radiation exit surface and from the back at which, for example, the back of the radiation-emitting device or of an element connected thereto may be uncovered. The external appearance of the light emitter, in particular also in the "off" state, may thus be co-determined by the device or elements connected thereto.

The housing part may have no cut-outs, in particular in the region of the receptacle. If the housing part has no cut-out, it may conceal other elements which are less aesthetically pleasing than the housing part.

The cover part may be of electrically conductive construction.

The cover part may be of thermally conductive construction. The cover part may thus be used to dissipate waste heat from the device.

The cover part may be of magnetic, in particular ferromagnetic, construction. The cover part may be fastened detachably to the housing part via magnetic forces.

The housing part may be of electrically insulating construction.

The housing part may be one or more connectors that connect with the cover part and in particular for fastening purposes. The respective connector may be designed for detachable or nondetachable connection. The respective connector is preferably designed for mechanically robust connection. If the, in particular detachable, connection is brought about by way of magnetic forces, it may be advantageous to provide one or more magnets as a connector. These magnets may be distributed around the circumference of the housing part at the edge thereof. For a nondetachable connection, mutually corresponding latching devices may be provided as connectors on the cover and housing parts. The latching connection formed between the latching devices is then a nondetachable connection, i.e. a connection that cannot be undone without destroying one of the connector.

The light emitter may comprise one or more, for example, two external electrical terminal parts. The respective terminal part may be provided for electrically conductive connection of the light emitter to an external power source. The device can be supplied with electrical power via the respective terminal part. The respective terminal part may be provided for connection with a direct voltage source. The respective terminal part may be mounted in the housing part and accessible from outside. The respective terminal part is conveniently connected electrically conductively with an electrical contact of the device. The device may have more contacts than the light emitter has external electrical terminal parts. In particular, the device may comprise more contacts of one polarity—anode or cathode—than the light emitter has external terminal parts for this polarity. By way of suitable electrical connections in the light emitter, it is possible in particular to guide two electrical contacts of one polarity to a common terminal part and connect them electrically conductively therewith.

The respective external electrical terminal part may take the form of a connecting part for an electrical plug connection. One of the terminal parts may take the form of a male connecting part, for example, a plug, and the other terminal part may take the form of a female connecting part, for example, a socket of an electrical plug connection. Plug connectors are familiar even to the uninformed user such as the end consumer, and are simple for such a user to use. Accordingly, plug connectors are particularly suitable for electrically conductive connection of the light emitter to the luminaire. The respective terminal part may take the form, for example, of a connecting part for a jack plug connection. The respective connecting part for the plug connection may take the form of a single-pole connecting part. In this case, the respective terminal part is preferably provided for one polarity. It is also conceivable, however, to combine two polarities in one connecting part, for example, in a two-pole jack plug. Two different connecting parts for different polarities offer the possibility, however, of connecting a plurality of light emitters together electrically and preferably also mechanically via the terminal parts, before the then as yet unoccupied end terminal parts are connected to a power source.

When viewed in plan view onto the radiation exit surface of the light emitter, two external electrical terminal parts may be arranged at two opposing, preferably diametrically opposed, points.

Two terminal parts may be oriented along an axis which may extend through both terminal parts. In particular, the plug-in direction to form a plug connection with the respective terminal part may extend along this axis. Both terminal parts may lie on the axis. If the terminal parts are oriented along one axis, the light emitter installed in the luminaire, the two terminal parts of which light emitters are connected to terminals of the luminaire, may still be moved, in particular rotated, about the axis. The terminal parts may thus form a part of a pivot bearing for the light emitter in the luminaire. The elongate connecting parts for a jack plug connection are particularly suitable for orientation along the axis. Since jack plugs do not comprise anti-rotation catches, rotatability is also ensured.

The light emitter may comprise a retaining device. The retaining device and a terminal part may be oriented along a common axis. The axis may extend through the retaining device and the terminal part. When viewed in plan view onto the radiation exit surface of the light emitter, the terminal part and the retaining device may be arranged at two opposing, preferably diametrically opposed, points. The terminal part may take the form of a two-pole connecting part for a plug connection, for example, a jack plug connection such as, for instance, a plug or socket. The retaining device may connect to a retaining element of a luminaire to retain the light emitter in the luminaire. This conveniently mechanically stable connection preferably enables relative rotation between retaining element and retaining device, when these are connected together.

The radiation-emitting device may comprise a plurality of electrical contacts of the same polarity. Furthermore, the device preferably comprises at least two contacts of different polarity.

The light emitter may comprise a conductor part. The conductor part preferably comprises at least one or more connecting conductors. The respective connecting conductor may connect a contact of the device with an external electrical terminal part of the light emitter. A plurality of contacts of the same polarity may be connected via connecting conductors of the conductor part with a common external electrical terminal part of the light emitter. In this way, contacts of the same polarity may be supplied to a common terminal part. The number of terminals required for electrical contacting is in this way advantageously reduced relative to a light emitter in which each contact has to be contacted separately externally. The conductor part connecting conductors for different polarities are conveniently insulated electrically from one another to prevent a short circuit.

The conductor part may be joined mechanically to the device via a joining layer. The joining layer is, for example, electrically insulating.

The conductor part may be connected electrically conductively to the device via an electrically conductive layer, preferably an anisotropic electrically conductive layer. The above-mentioned joining layer may differ from the electrically conductive layer.

The respective external electrical terminal part may be connected electrically conductively and preferably mechanically to the conductor part, in particular by soldering. A soldered joint is distinguished by particularly high mechanical stability.

The conductor part may be a flexible conductor part such as a flexible printed circuit board or comprises such. A flexible printed circuit board, in particular with a film as printed circuit board conductor carrier, is particularly suitable to form thin light emitters.

The cover part may comprise one or more fixing elements. The respective fixing element is preferably configured and arranged to secure one of the terminal parts against movement relative to the housing part, in particular when the cover part is joined to the housing part. The respective fixing element may take the form of a projection of the cover part. The respective fixing element may be further away from a rim of the housing part than a part of a terminal part which is arranged between the fixing part and the housing part. Accordingly, this terminal part may be mounted between the fixing element and the housing part. The respective fixing element conveniently prevents the terminal part from slipping into the housing part receptacle on connection with a luminaire, for example, by plug connection. A fixing element is preferably associated with each terminal part.

The cover part may comprise one or more thermal contact elements. The cover part may be connected thermally conductively to the device via the respective thermal contact element. Waste heat from the device may thus be fed to the cover part and dissipated via the cover part to the surrounding environment. The service life of the device can be increased in this way.

A heat-conducting element, for example a heat-conducting film, may be arranged on the device and connected thermally conductively with the device. The heat-conducting element may comprise a thermal land. When viewed in plan view onto the radiation exit surface, the thermal land may be arranged next to the radiation exit surface. The thermal land may be connected in heat-conducting manner with a thermal contact element of the cover part. The heat-conducting element may be of large-area construction.

It may completely cover the device. Heat may be distributed homogeneously over the surface of the device via the heat-conducting element. Temperature fluctuations over the device in plan view onto the radiation exit surface, which might cause fluctuations in exit-side luminance distribution, may in this way be reduced or prevented.

The cover part and/or the housing part may be opaque.

Use of at least one connecting part for a jack plug connection may be provided. The connecting part is preferably used as an external electrical terminal part of a light emitter with a preferably organic optoelectronic device. As described above, a jack plug connection has particular advantages, in particular in the case of flat devices such as OLEDs.

Preferably, a light emitter with a radiation exit surface is provided, wherein the light emitter comprises:

- a housing part with a receptacle,
- at least one organic optoelectronic device arranged in the receptacle, and
- at least one cover part joined to the housing part, wherein the device is mounted between the cover part and the housing part.

Further advantages, advantageous configurations and convenient aspects are revealed by the following description of the examples in conjunction with the figures.

Identical, similar and identically acting elements are provided with identical reference numerals in the Figures.

Figure 2:
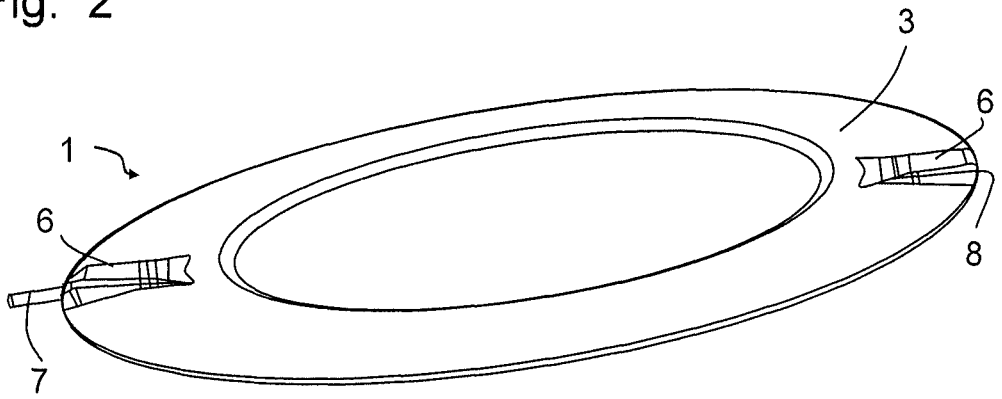

FIGS. 1 and 2 show schematic representations of a light emitter 1. FIG. 1 shows an oblique view of one side of the light emitter 1 with a radiation exit surface 2. This side is herein also designated the front. FIG. 2 shows a schematic oblique view of a side of the light emitter 1 remote from the radiation exit surface 2, which side is herein also designated the back.

The light emitter 1 comprises a housing part 3 and a cover part 4. The light emitter 1 further comprises an optoelectronic device 5. The device 5 preferably takes the form of an organic electroluminescent device, for example, an organic luminescent diode (OLED). The organic electroluminescent device conveniently comprises organic functional material which emits radiation, preferably radiation in the visible spectral range, when appropriately supplied with electrical power.

The cover part 4 conveniently covers, in particular at the front, the elements of the light emitter 1 arranged inside the housing part 3, conveniently apart from the radiation exit surface 2, which may be formed by the radiation exit surface of the device 5. Viewed in plan view onto the radiation exit surface, the cover part 4 may be configured with a central cut-out, being annular, for example. The cross section of the cover part 4 may taper towards the cut-out. The cover part 4 may, for example, be rounded towards the cut-out. The overall aesthetic impression may be improved in this way. The cross section of the cover part 4 may moreover taper outwards (not shown explicitly).

The cross section of the housing part 3 may taper outwardly. This may be suitable to provide a thinner overall impression of the light emitter 1. Like the cover part 4, the housing part 3 may have a cut-out and in particular may be annular in plan view. The cut-out in the cover part 4 preferably completely covers that in the housing part 3. The rear cut-out may consequently be smaller than the front cut-out. Even when the luminaire is off, the size ratios indicate to the user that, in operation, radiation passes through the larger of the two cut-outs. Undesired glare resulting from incorrect orientation of the radiation exit surface can thus be avoided.

Alternatively, the two cut-outs may be congruent in plan view.

The cross section of the housing part 3 may taper towards the cut-out in the housing part, wherein the increase in curvature in the direction of the cut-out is preferably greater than that in the direction of the outer rim of the cover part 4. As a result of the profile of the housing part 3 and preferably of the cover part 4 being rounded in the direction of the outer rim, a thinner overall impression may be achieved for the light emitter 1.

The light emitter 1 may have a maximum thickness of 8 mm or less, for example, around 6 mm. The above-mentioned shaping of the housing part 3 and preferably of the cover part 4 may give the user the impression that the light emitter is even thinner.

The cover part 4 is preferably substantially flat on the outside. One or more raised portions 6 may be provided on the outside in the housing part 3. The raised portions 6 are preferably oriented along a common axis, which may extend through these elements. A raised portion 6 may be provided in a region of the outer surface in which a terminal part (see further below) is arranged in the housing part 3 and passes out from the inside of the housing part.

The light emitter 1 further comprises at least one external electrical terminal part 7. In the example shown, the light emitter comprises two electrical terminal parts. In addition to the terminal part 7, a further terminal part 8 is also provided. The external electrical terminal parts 7 and 8 are preferably provided for different polarities. One thereof may be provided as an anode terminal part and the other as a cathode terminal part to contact electrical contacts of the device 5. Electrical power may be supplied to the device 5 via the respective electrical terminal part 7, 8. The respective terminal part 7, 8 may be provided to connect with a direct voltage source.

The respective external electrical terminal part 7 or 8 takes the form of a connecting part for an electrical plug connection. The respective terminal part may take the form of a standard plug connector. In this case, the terminal part 7 takes the form of a male part for a plug connection, while the terminal part 8 takes the form of a female part for a plug connection 8. The further terminal part 8 is conveniently configured such that it could enter into plug connection with another terminal part of another light emitter, which is shaped in accordance with the terminal part 7. Series connection of a plurality of described light emitter 1 is thereby simplified.

The external electrical terminal parts 7 and 8 illustrated are configured for a jack plug connection, wherein the terminal part 7 is a plug and the terminal part 8 is a socket. A jack plug connection has the advantage that, when the jack plug connection is formed, the light emitter may still be rotatable relative to the elements contacted by means of the plug connection. The terminal parts 7 and 8 preferably lie in alignment on an axis, so simplifying rotation of the light emitter when installed. The terminal parts 7 and 8 may be arranged offset relative to one another by 180°. In other words, the terminal parts may be arranged at diametrically opposed points of the light emitter. In the example shown, the light emitter 1 has a shape which is substantially circular in plan view, apart from the terminal parts 7 and 8. If the light emitter is not substantially circular in shape, it may be advantageous to arrange the terminal parts 7 and 8 at points diametrically opposite one another in the region of the light emitter with the greatest diameter to simplify rotation of the light emitter when installed. As an alternative to the representation with two electrical terminal parts 7 and 8, it is optionally also possible for just one electrical terminal part 7 to be provided. More than two terminal parts may also be provided.

In the example shown, the terminal parts 7 and 8 are of single-pole construction, which is sufficient to contact the two poles of a diode such as an OLED. If terminal part 7 or 8 is omitted, the remaining terminal part must be of multi-pole, e.g. two-pole, configuration.

The light emitter 1 may take the form of a flat light emitter. The thickness of the light emitter is preferably significantly less than the maximum or minimum lateral dimension of the radiation exit surface 2 of the light emitter 1. The lateral dimension may be the diameter of the radiation exit surface, the length thereof or indeed the width thereof. The thickness is, for example, less than a quarter, less than a fifth or even less than a sixth of the maximum or minimum lateral dimension.

The cover part 4 is joined to the housing part 3. The parts are joined together such that the device 5 is mounted in a mechanically stable manner between the housing part 3 and the cover part 4. To this end, a retaining space, for example, a retaining groove, may be formed between the housing part 3 and the cover part 4, in which space part of the device 5 is arranged, for example, a peripheral region of the device 5, which extends next to the radiation exit surface. The retaining space is preferably provided around the entire circumference.

The cover part 4 and the housing part 3 are preferably of mechanically stable, for example, self-supporting construction. The cover part 4 and the housing part 3 may consequently together form a housing for the device of the light emitter 1 which protects sensitive elements, for example, electrical conductors from harmful external influences. At the same time, the housing may determine the overall aesthetic impression of the light emitter. In particular, the housing may be aesthetically more pleasing than the device 5 in itself.

Figure 3:
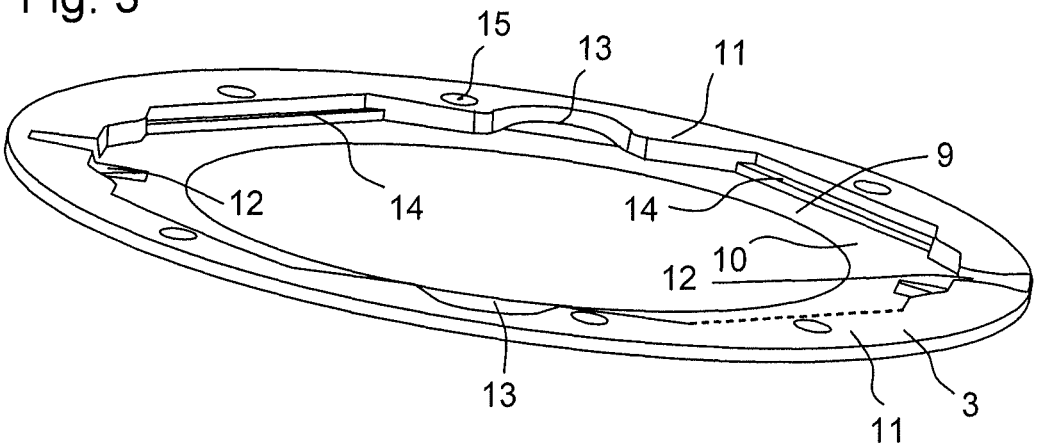
FIGS. 3 and 4 show different schematic oblique views of a housing part for the light emitter.
Figure 4:
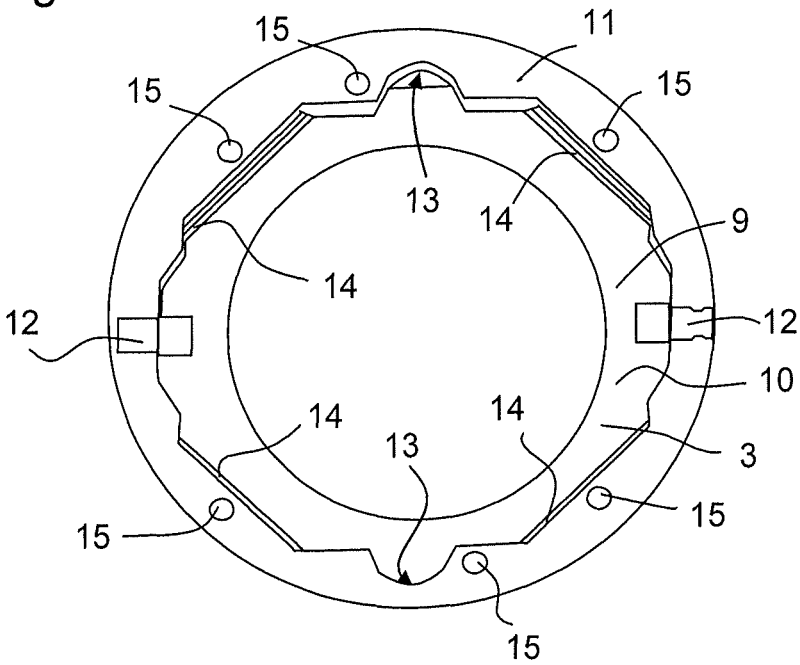

FIGS. 3 and 4 show the housing part 3 of the light emitter 1 in oblique views. The cut-out in the housing part allows the dissipation of waste heat from the device to the surrounding environment, without it having to be passed through the material of the housing part 3. The thermal load on the housing part 3 can be reduced in this way.

The housing part 3 comprises a receptacle 9, which is constructed to accommodate the device 5. The receptacle 9 conveniently comprises a bearing surface 10 for bearing the device 5. The bearing surface 10 may surround the cut-out in the housing part. The housing part 3 further comprises a rim or frame 11. The rim 11 rises above the bearing surface 10. The rim 11 preferably projects above the radiation exit surface of the device 5 inserted into the receptacle 9. The rim 11 externally delimits the bearing surface 10. The rim 11 may laterally delimit the receptacle 9, in particular around its entire circumference. The receptacle 9 has a shape adapted to the shape of the device 5. In particular, the device 5 and then preferably also the receptacle may be angular in shape, for example, they may be polygonal in shape in plan view. The shape may for instance be substantially hexagonal or octagonal (cf. also FIGS. 8 and 9 with regard to the device). The receptacle 9 may comprise corresponding corners such that the device 5 inserted into the receptacle 9 is secured against rotation of the device relative to the housing part 3. The above-mentioned retaining space may be formed between the bearing surface 10 and an interior surface of the cover part 4, when the cover part is joined to the housing part 3.

Feedthroughs for the terminal parts 7 and 8 pass outwards from the bearing surface 10. The respective feedthrough 12 passes through the rim 11 and a terminal part 7 or 8 respectively may pass outwards therethrough from the receptacle 9. In the region of the feedthrough the housing part 3 may comprise a recess. The respective feedthrough 12 is lower than the bearing surface 10. The respective feedthrough 12 may be joined to the bearing surface 10, for example, via an obliquely extending joining region. A lower arrangement of the feedthrough offers space for the accommodation of relatively bulky elements such as, for instance, connectors for the terminal parts.

The receptacle 9 further comprises at least one, in the example two, convexities 13, which are preferably directed outwardly, for example, radially outwardly. The respective convexity is preferably joined to the bearing surface 10. The position of the respective convexity 13 is preferably offset relative to that of the respective feedthrough 12, for example, by 90°.

When device 5 is inserted into the receptacle, the respective convexity 13 is preferably not occupied by the device. Instead, a heat-conducting element (cf. the heat-conducting element 19 below) conveniently projects into the convexity and is in places accessible there when the cover part 4 is not joined to the housing part 3.

The housing part 3 is preferably made of electrically insulating material. The housing part may contain a plastics material, for example, polycarbonate (PC), acrylonitrile butadiene styrene (ABS) or polybutylene terephthalate (PBT).

In one or more regions the transition between the bearing surface 10 and the rim 11 is provided with an additional step 14. The respective step is preferably arranged in a region of the receptacle in which, when device 5 is inserted, an electrical contact of the device is arranged (cf. the description of the device below). The respective contact may extend over the step 14 when the device is arranged in the receptacle 9.

The rim 11 is conveniently provided to form the mechanically stable connection between housing part 3 and cover part 4. The rim 11 may be provided to this end with connector 15. The connector 15 may be distributed around the circumference of the rim 11. This makes it simpler to achieve uniformly stable mechanical fastening around the circumference.

The cover part 4 is conveniently joined detachably to the housing part 3. This simplifies replacement of a device 5, which is necessary if a device 5 is defective. For detachable connection, the connector 15 may, for example, comprise magnets such as permanent magnets, which are preferably let into the rim 11 of the housing part 3 to not increase unnecessarily the thickness of the light emitter. Preferably all around its circumference, the cover part 4 contains magnetic material, in particular ferromagnetic material, or consists of such a material. Fastening to the housing part 3 by magnetic connector 15 is thereby simplified.

Figure 5:
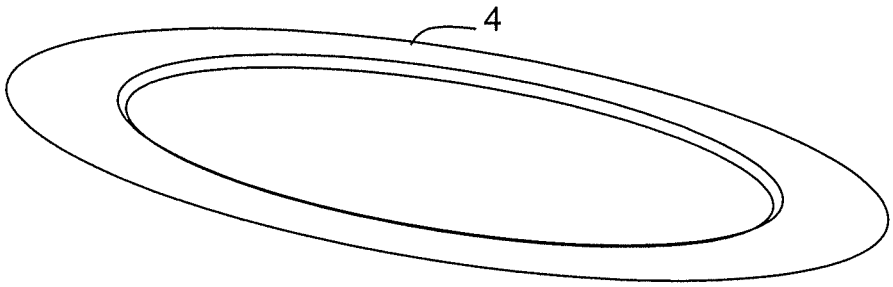
FIGS. 5 and 6 show different schematic oblique views of a cover part for the light emitter according to the example.
Figure 6:
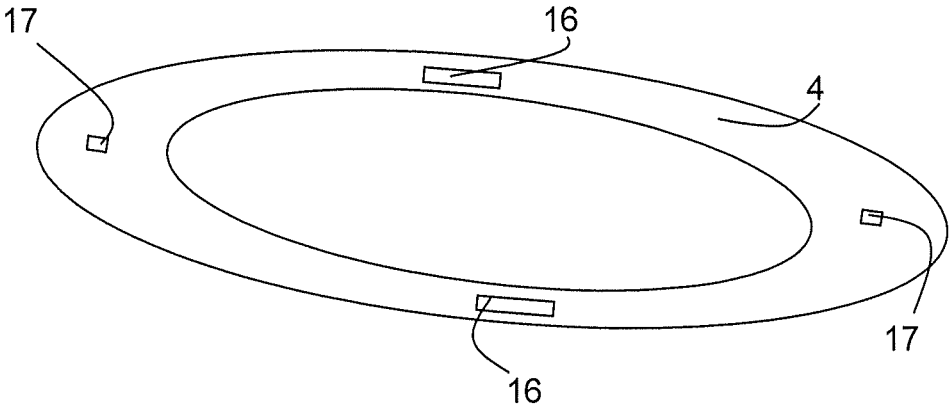

FIGS. 5 and 6 each show an oblique plan view of the cover part 4, FIG. 5 from the front, which forms part of the outer surface of the light emitter 1, and FIG. 6 from the back, which is internal to the light emitter.

In particular on the inside, the cover part 4 comprises one or more thermal contact elements 16. The respective contact element may take the form of a projection. The respective contact element 16 may project from a bearing surface of the cover part 4 with which the cover part rests on the rim 11 of the housing part when joined thereto. Two thermal contact elements 16 are preferably arranged at points of the cover part 4 diametrically opposite to one another. When the cover part 4 is placed on the housing part 3 and joined thereto, the respective thermal contact element 16 is preferably arranged in the region of a convexity 13. The respective thermal contact element connects thermally conductively to the device, for example, via a heat-conducting element, when the housing part is joined to the cover part. Heat may be dissipated from the device via the respective thermal contact element and fed to the cover part 4. The heat is then dissipated to the surrounding environment via the cover part.

The cover part preferably comprises or consists of a material which is ferromagnetic and/or conducts heat well. Iron or low alloy steel are examples of materials that both conduct heat well and are ferromagnetic.

The cover part 4 comprises one or more fixing elements 17. The respective fixing element 17 is electrically insulating. The respective fixing element may take the form of a projection. The respective fixing element 17 may project from a bearing surface of the cover part 4 with which the cover part rests on the rim 11 of the housing part 3 when joined thereto. To this end, the respective fixing element 17 is conveniently arranged and configured to prevent movement of one of terminal parts 7 or 8 relative to the housing part, in particular into the receptacle 9, when the cover part 4 is joined to the housing part 3. A terminal part 7 or 8 may, for example, be mounted by the fixing element 17 on the one side and by a region of the housing part on the other side, for example, by press fit. The fixing elements 17 are preferably provided at diametrically opposed points.

When the cover part 4 is joined to the housing part 3, the respective fixing element is conveniently arranged in the region of the respective feedthrough 12. The respective thermal contact element 16 is preferably of larger-area construction than the respective fixing element 17. A larger surface area is of considerable advantage for thermal connection. Mechanical stabilization of the respective terminal part may also be achieved by a smaller fixing element.

Figure 7:
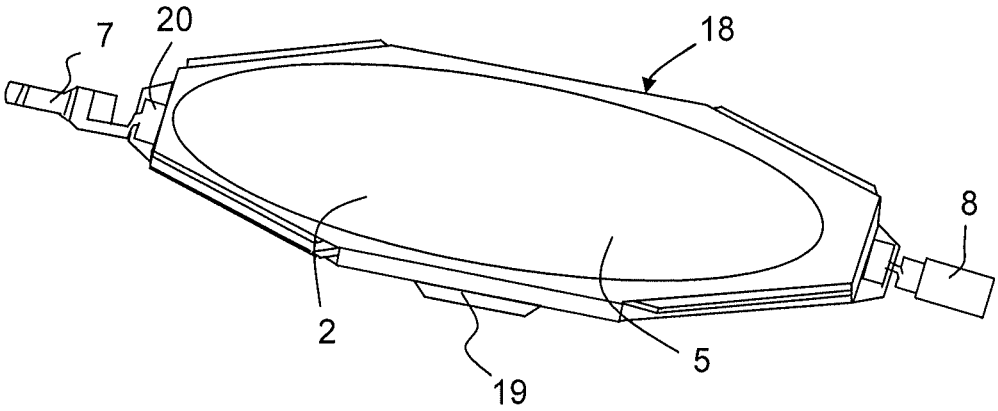
FIG. 7 shows a module for the light emitter with an optoelectronic device according to the example.

FIG. 7 shows a module 18 comprising the device 5 and one or more further elements. The module may be prefabricated with all the elements illustrated and introduced as a prefabricated module into the receptacle 9 of the housing part 3 before the cover part 4 is joined to the housing part.

In addition to the device, the module 18 may also comprise a heat-conducting element 19. The module 18 may further comprise a conductor part 20. The module 18 further comprises the external electrical terminal parts 7 and 8. The conductor part 20 may be arranged between heat-conducting element 19 and device 5. The external electrical terminal parts 7 and 8 are conveniently fastened to the conductor part 20 and electrically conductively connected via connecting conductors provided on the conductor part, but are not explicitly illustrated, with electrical contacts of the device 5.

FIGS. 8 to 11 show schematic diagrams of the individual elements of the module 18.

Figure 8:
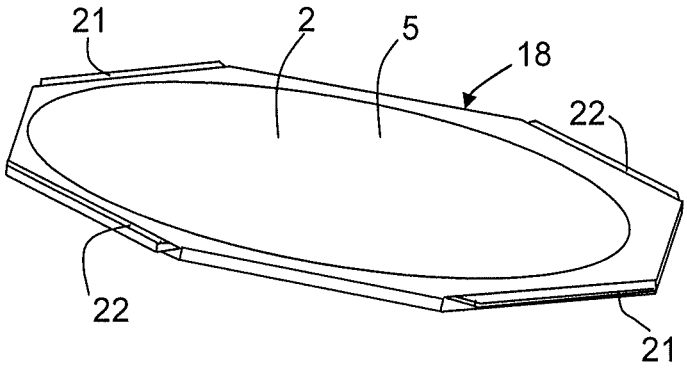
FIGS. 8 and 9 show different schematic oblique views of a device for the module according to the example.
Figure 9:
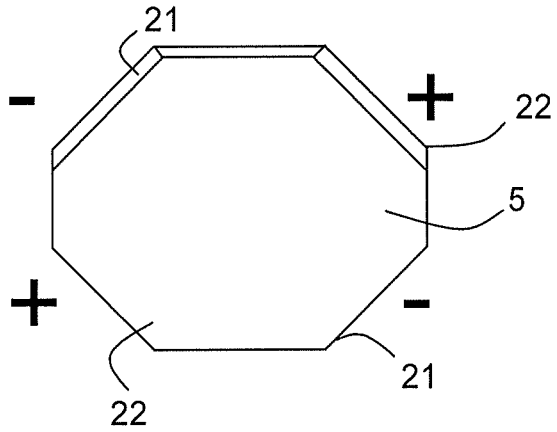

The device 5 is shown schematically in FIGS. 8 and 9. The device 5 may, for example, take the form of an OLED tile. The device 5 comprises a plurality of external contacts 21 of a first polarity, e.g. anode or cathode. The device comprises a plurality of electrical contacts 22 of a second polarity, e.g. cathode or anode. The respective contact may be configured as a contact strip provided externally on the device 5, the contact strip being conveniently of elongate construction. The respective contact may be configured to project radially. The contacts 21 and 22 are illustrated schematically in FIGS. 8 and 9.

A plurality of contacts of the same polarity may homogenize charge carrier injection into the organic functional material of the device. More homogeneous charge carrier injection may bring about homogenized luminance distribution over the radiation exit surface 2. The device 5 may have an optical outcoupling structure such as a scattering film or a microlens array (not illustrated explicitly). Moreover, the device or its organic functional material is protected against external influences such as moisture, preferably by thin-film encapsulation. Thin-film encapsulation, which is produced, for example, by deposition, often has lower resistance to heat transfer from the organic functional material than thick encapsulation.

Figure 10:
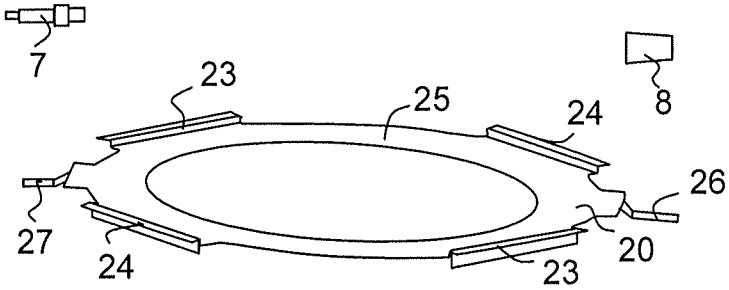
FIG. 10 shows a conductor part for the module and electrical terminal parts for the module for fastening to the conductor part according to the example.

FIG. 10 shows the conductor part 20 with the electrical terminal parts 7 and 8 not as yet fastened thereto. The conductor part 20 may have a cut-out, for example, in a central region like the housing part 3. In this way, the usually unattractive conductor part 20 cannot be seen from the rear of the light emitter 1, irrespective of whether or not a heat-conducting element 19 is provided. In addition, a conductor part 20 with a cut-out contributes only slightly to thermal resistance in the event of the transfer of heat to the outside via the heat-conducting element 19. The heat-conducting element 19 may form an outer surface of the light emitter 1, in particular the rear outer surface.

The conductor part 20 has a plurality of contact regions 23, 24. The conductor part additionally has a connecting conductor guide surface 25. The contact regions 23 are preferably provided for electrically conductive connection with the contacts of first polarity 21, and the contact regions 24 for electrically conductive connection with the contacts of second polarity 22. Via connecting conductors on the connecting conductor guide surface 25 of the conductor part 20 (not illustrated explicitly), which are connected electrically with contact regions 23, 24, but are preferably isolated electrically from one another on the conductor part, contacts 21 or 22 of the device 5 of identical polarity connect with a common electrical terminal part 7 or 8, respectively. In this way, the number of external electrical terminal parts may be reduced compared to the number of electrical contacts of the device, in the example shown from four to two.

The contact regions 23 and 24 may project from the connecting conductor guide surface 25 of the conductor part 20. The connecting conductor guide surface 25 may constitute a border surrounding the cut-out in the conductor part 20. The respective contact region may be offset axially, for example offset in the manner of a step, relative to the connecting conductor guide surface 25. The respective contact region is preferably directed radially outwardly. When the module 18 is introduced into the receptacle, the respective contact region 23, 24 is preferably arranged over the step 14 and may rest thereon.

Figure 12:
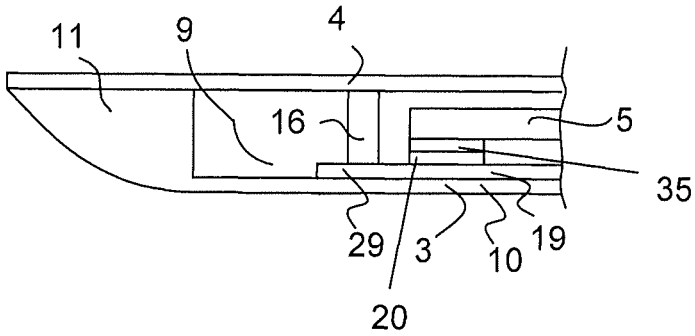
FIG. 12 shows, by way of a schematic sectional view, a part of the light emitter, the thermal connection between cover part and device according to the example.

In the module 18 the conductor part 20 may be joined, in particular bonded, to the device via a joining layer 35 (see FIG. 12). The joining layer may contain an adhesive. The joining layer may take the form of double-sided adhesive tape. The joining layer is conveniently electrically insulating so that connecting conductors extending on the conductor part 20 are not short-circuited. The conductor part 20 may be bonded over a large-area to the device 5 by the joining layer 35. The connecting conductor guide face 25 of the conductor part 20 may, for example, be joined mechanically, for instance adhesively bonded, to the device 5 via the joining layer 35.

The respective contact region 23, 24 may electrically conductively connect to the device via an anisotropic electrically conductive layer (not illustrated explicitly). This layer may be electrically conductive in some regions and electrically insulating in other regions. In the contact regions 23, 24 to the contacts 21, 22 of the device 5, the layer is conveniently conductive to produce the electrical connection between the device and the conductor part 20. Outside contact regions 23 or 24 the layer is conveniently electrically insulating.

The respective contact region 23 or 24 may be joined to the optoelectronic device by an ACF process (also known as "bonding"). In an ACF process (ACF=anisotropic conductive film) an actually electrically insulating connector, such as a non-conductive adhesive which is, however, combined with electrically conductive particles, is made conductive in selected regions by selective application of pressure and/or heat, for example, by increasing the density of conductive particles while it remains electrically insulating in other regions to which pressure and/or heat was not applied.

The conductor part 20 further comprises one or more lands 26, 27. In the module 18 the lands are only indirectly joined mechanically to the device 5. In other words, the lands are free from the joining layer. When viewed in plan view, the lands 26, 27 may be arranged next to the device 5. When viewed in plan view, the lands 26, 27 may project radially outwardly from the connecting conductor guide surface 25. The lands 26, 27 may be offset axially relative to the connecting conductor guide surface 25, in particular towards the back of the light emitter 1. In the region of the lands 26, 27, the electrical terminal parts 7 or 8 connect electrically conductively to the conductor part 20, for example, by soldering.

The conductor part 20 may be of flexible construction, for example, it may take the form of a flexible printed circuit board, for instance "flex board" or "flex PCB" (PCB=printed circuit board).

In the module 18 the lands 26, 27 of the conductor part 20 with the terminal parts 7 or 8, respectively, fastened thereto are conveniently of flexible construction, which simplifies introduction of the terminal parts into the feedthroughs 12.

An ESD protective component (not illustrated explicitly) such as a protective diode, may be arranged on the conductor part 20. The protective diode conveniently connects antiparallel to the optoelectronic device and preferably also connects electrically conductively to the terminal parts 7 and 8.

The conductor part 20 may comprise a foil as a carrier for the conductors of the conductor part. The foil may comprise Kapton®. The foil is preferably thin, for example, with a thickness of 350 μm or less, preferably with a thickness of 200 μm or less. The conductor part 20 may overall have a thickness of 350 μm or less, preferably 200 μm or less.

The shape of the conductor part 20, in particular the outline, may be adapted to that of the device 5, wherein optionally slight protrusions may be present such as in the region of the contact zones 23, 24 and the lands 26 and 27.

Figure 11:
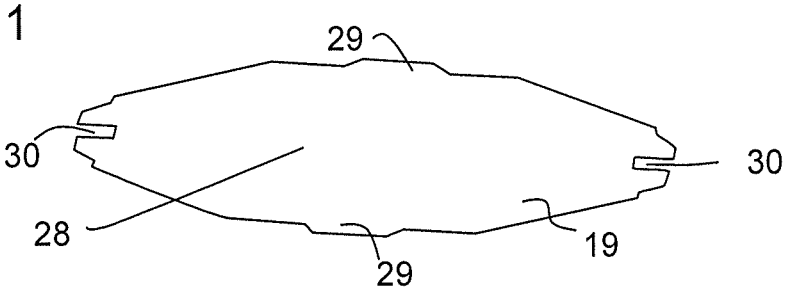
FIG. 11 shows a schematic plan view of a heat-conducting element for the module according to the example.

FIG. 11 shows a schematic plan view of the heat-conducting element 19 of the module 18. The heat-conducting element 19 comprises a joining surface 28. On this surface the heat-conducting element 19 in the module 18 is conveniently joined thermally conductively to the device 5, for example, adhesively bonded. One or more thermal lands 29 of the heat-conducting element 19 may be provided outside the connection zone with the device, in particular protruding radially from the joining surface 28. The respective thermal land 29 is arranged in the module 18 conveniently in the region of the convexity 13 of the housing part 3 and joins thermally conductively to the associated thermal contact element 16 of the cover part 4, for example, via a heat transfer paste.

Moreover, the heat-conducting element 19 comprises one or more recesses 30 at the rim. In the module 18 the regions of the conductor part 20 with the lands 26, 27 may extend through this recess 30.

The heat-conducting element 19 may take the form of a heat distribution film/foil, for example, a metal foil or graphite film. The film/foil is preferably thin. The film/foil may have a thickness of 500 μm or less.

The heat-conducting element 19 is preferably joined over substantially its entire surface to the back of the device. Moreover, the heat-conducting element 19 is joined thermally conductively via the thermal contact elements 16 to the cover part 4 and thus to the front of the light emitter 1. Heat may be dissipated to the surrounding environment via the cover part 4. This may reduce the temperature of the device when in operation, whereby service life may be increased. With organic devices in particular, just a 3° C. lower operating temperature results in a 10% increase in service life.

The heat-conducting element 19 may form a part of the outer surface of the light emitter 1, in particular a part of the rear outer surface. Since in this case the heat-conducting element 19 is visible from outside, for instance through the rear cut-out in the housing part 3, the heat-conducting element 19 may additionally be provided with a further element, for example, a film or a coating material, so resulting in a higher quality external aesthetic appearance.

FIG. 12 shows by part of the light emitter 1 the profile of the thermal contact element, which extends next to the device from the cover part 4 as far as the thermal land 29 of the heat-conducting element 19 and there is connected thermally to the heat-conducting element. Moreover, the taper of the rim 11 of the housing part 3 is visible in the outer peripheral area of the light emitter 1, the taper bringing about a shallower overall impression.

Figure 13:
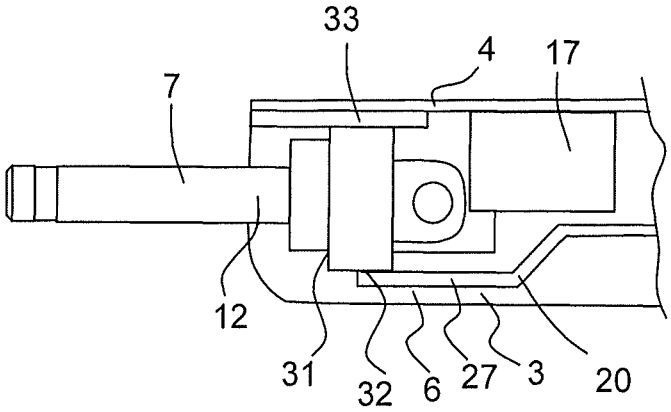
FIG. 13 shows, by way of a schematic sectional view a part of the light emitter, fixing of an electrical terminal part in the light emitter according to the example.

FIG. 13 shows more precisely, by a schematic sectional view of part of the light emitter 1, the mode of operation of the fixing element 17 through interaction thereof with the electrical terminal part 7. An example for terminal part 8 may be the same. The external terminal part 7 is passed outwardly from the receptacle 9 through the feedthrough 12, which is preferably provided laterally in the housing part 3. Part of the terminal part 7 conveniently remains in the housing part 3. This part may comprise a projection which is conveniently larger than the dimensions of the feedthrough. Thus, the terminal part 7 cannot be drawn fully out of the housing.

In the housing part 3, a limit stop may be formed by the projecting part of the terminal part 7 and a part of the housing part 3. Such a limit stop is shown in FIG. 13 with reference numeral 31.

The electrical terminal part 7 is safeguarded against movement into the housing part 3 by the fixing element 17, which may form a limit stop for movement of the electrical terminal part 7 relative to the housing part 3. With the limit stop 31 formed by the housing part 3 and of the fixing element 17, the electrical terminal part 7 may be mounted in a positionally stable manner, for example, clamped in the light emitter 1. In particular, axial displacement of the terminal part 7 may be prevented. If the electrical terminal part 7 is inserted into an external socket for contacting purposes, the terminal part cannot slip back into the housing part 3. The electrical terminal part is preferably held by press fit such that rotation of the electrical terminal part relative to the housing is also prevented. Damage to a soldered joint 32 between the conductor part 20 and the external terminal part 7 may thus be reduced.

The electrically conductive external electrical terminal part 7 is preferably insulated electrically from the cover part 4. The insulation may be achieved via an insulating material 33, for example, an insulating tape 33 which may be provided between the cover part 4 and the external electrical terminal part 7. The risk of a short circuit between the external terminal parts 7 and 8 via the cover part 4 is thus not increased, despite the small structural height.

Figure 14:
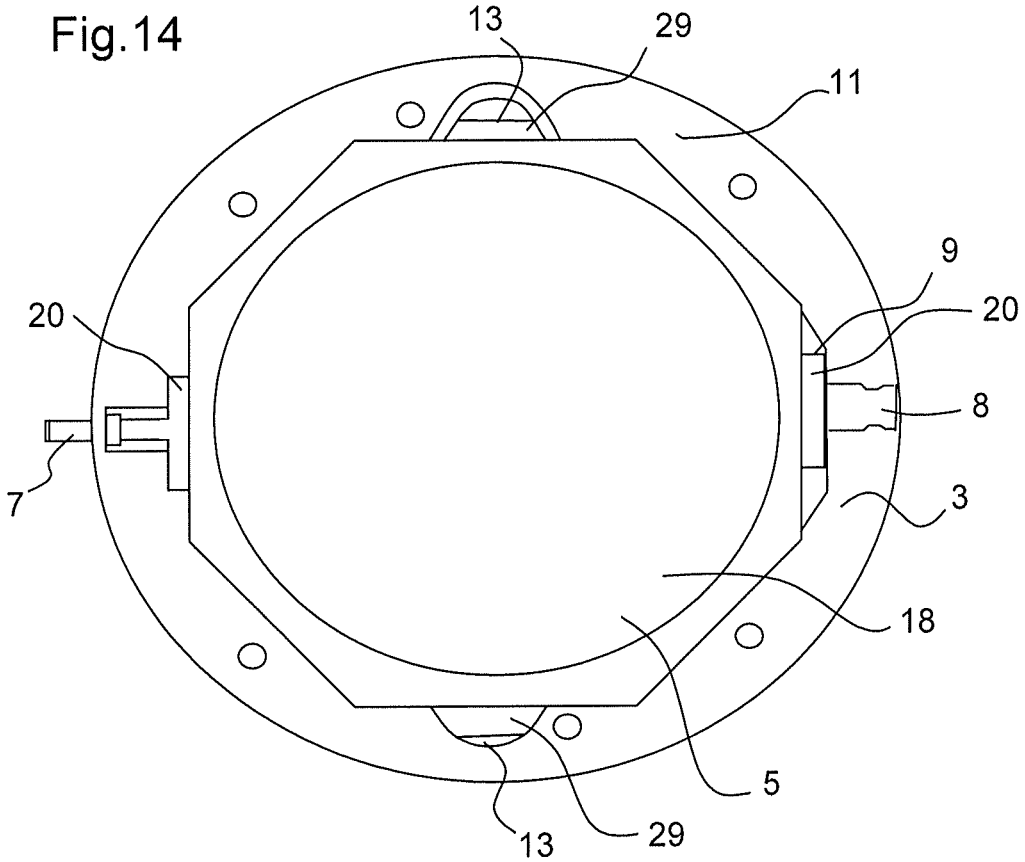
FIG. 14 shows a plan view of the light emitter with cover part removed according to the example.

FIG. 14 shows a plan view of the light emitter 1 with cover part 4 removed. The module 18 is inserted into the receptacle 9. Despite the perfect fit of the receptacle 9, it is possible to intervene manually in the receptacle 9 via the convexities 13 in which the optoelectronic component 5 is not arranged and to remove the entire module 18 from the receptacle 9. Due to the flexibility of the conductor part 20, the external terminals 7 and 8 may also be removed from the corresponding feedthroughs 12 with deformation of the conductor part.

Figure 15:
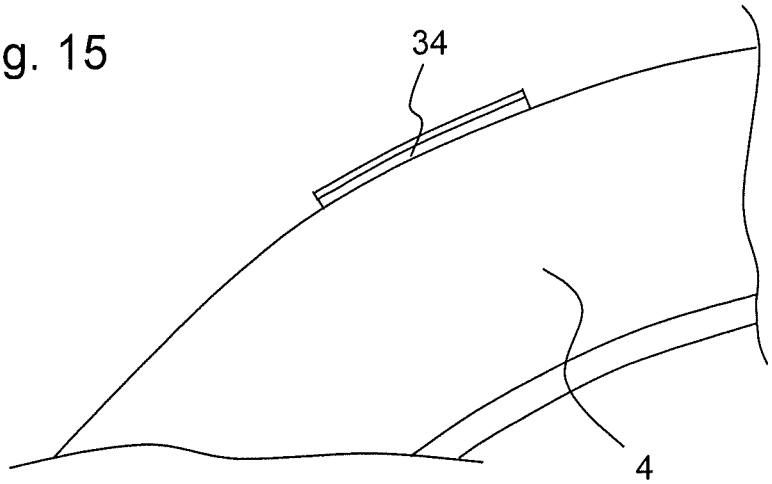
FIG. 15 shows a portion of the cover part according to the example.

If the optoelectronic device 5 is defective, the light emitter may be straightforwardly unplugged from the luminaire due to the simple plug connection. Due to the detachable connection between the cover part 4 and the housing part 3, the cover part 4 may be easily removed from the housing part 3. To simplify removal of the cover part 4, a slightly protruding or slightly recessed removal aid 34 may be provided on the cover part (see FIG. 15).

A defective module 18 may thus even be replaced simply by the end consumer with a new module which can be inserted into the receptacle 9 without deeper specialist technical knowledge, the terminal parts being passed to the outside. When the cover part 4 is then set back in place, the external terminal parts 7 and 8 are fixed in place and the light emitter 1 may be re-installed in the luminaire system.

The inner edge of the cut-out in the cover part 4 may also offer an application point for instance for a fingernail or for a screwdriver to detach the cover part 4 from the housing part 3. The removal aid 34 may thus optionally be omitted.

FIGS. 16 to 19 show variations of elements of the above-described example.

Figure 16:
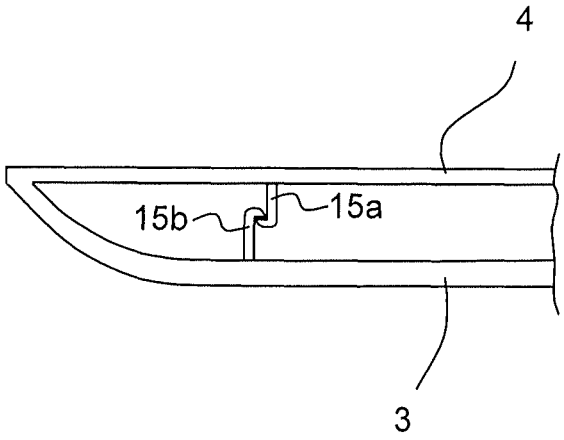
FIG. 16 shows an example of a nondetachable connection between housing and cover parts.

In the example according to FIG. 16, no connectors are provided for a detachable connection. Instead, connectors 15*a* and 15*b* are provided which form a non-detachable connection. In the example the connectors 15*a* and 15*b* are formed for a latching connection, for example, as latching hooks. The connectors 15*a* and 15*b* may be distributed at various points over the circumference of the housing part 3 and of the cover part 4, preferably in the respective peripheral region. The respective connectors 15*a*, 15*b* may project from the cover part 4 or the housing part 3 and connect to the other connectors. The respective connectors may be constructed in one piece with the housing part 3 or the cover part 4 or be fastened thereto as a separate element. Such a non-detachable connection may be provided in the case of the light emitter described above and below.

Figure 17:
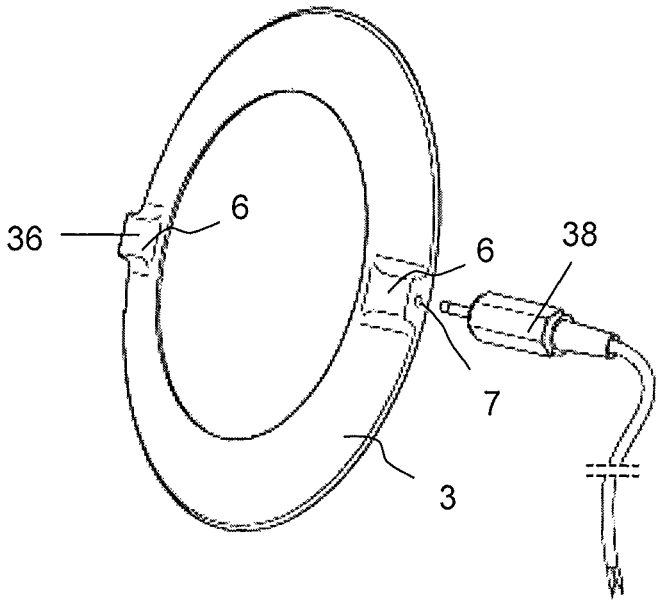
FIGS. 17 to 19 show a variation of the light emitter according to the example of FIGS. 1 to 16.
Figure 18:
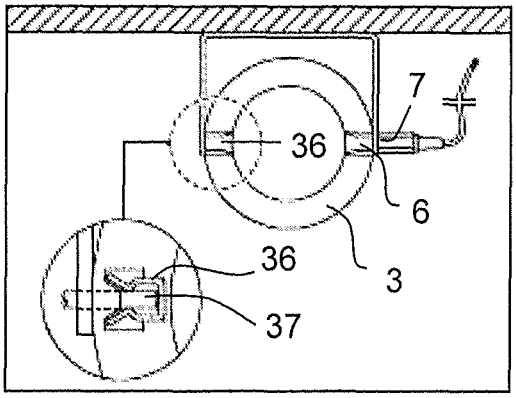
Figure 19:
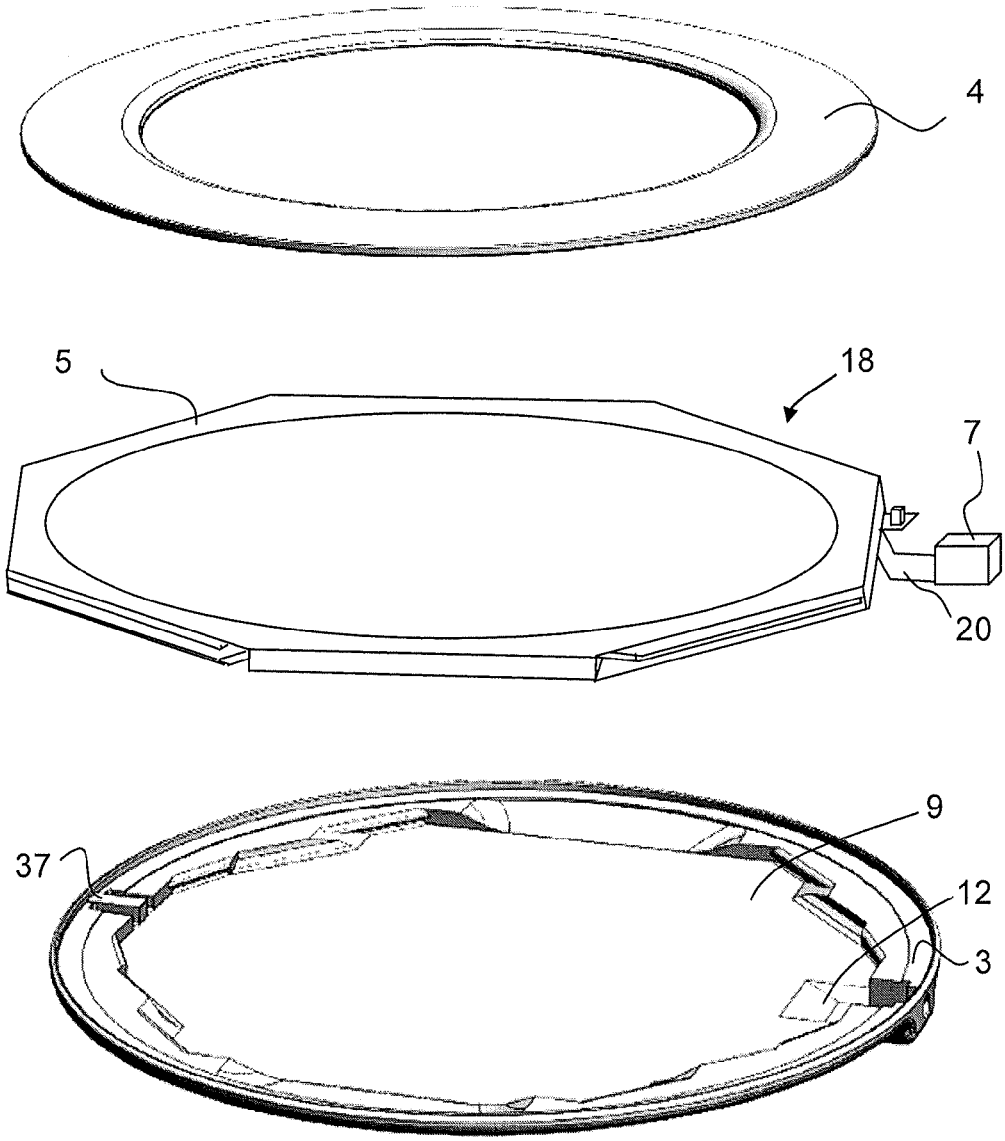

FIGS. 17 to 19 are schematic views of a variation of the above-described light emitter 1. The light emitter may correspond substantially to the light emitter described in conjunction with the preceding figures, insofar as no differences are indicated.

Like the above-described light emitter, the housing part 4 has two raised portions 6, which lie on a common axis and in particular are arranged in alignment. The raised portions may be arranged at points which are offset by 180° relative to one another. The light emitter 1 comprises an electrical terminal part 7, which takes the form of a connecting part for a two-pole plug connection, for example, a two-pole jack plug connection. The terminal part 7 may, for example, take the form of a socket. The jack plug 38 of a luminaire, which may engage in the socket, is shown schematically in FIG. 17. The terminal part 7 is conveniently arranged in the region of a raised portion 6.

Opposite the terminal part 7, in particular in the region of the other raised portion 6, a retaining device 36 is provided, which takes the form of a recess extending into the housing part. The recess preferably does not extend into the receptacle, but rather is delimited axially by an end stop. The retaining device 36 may be provided to accommodate a retaining element, for example, a retaining pin of the luminaire. The retaining connection formed between the retaining element and the retaining device preferably provides a robust safeguard against relative axial movement. Moreover, the retaining connection preferably allows rotational motion. Since the retaining device 36 and the terminal part 7 are aligned along a common axis which runs through the elements, the light emitter retained in the luminaire by the retaining device 36 and the terminal part 7 is rotatable about the axis in a manner similar to the light emitter from the previous figures, a terminal part 8 being replaced by the retaining device.

FIG. 18 shows a plan view of the light emitter 1 installed in the luminaire, the light emitter being fastened in the luminaire by a retaining element 37, for example, in the form of a retaining pin introduced into the retaining device 36. The retaining element 37 is conveniently safeguarded against axial movement relative to the retaining device 36. The receptacle-side boundary of the retaining device 36 forms an end stop for the retaining element 37.

FIG. 19 shows an exploded representation of the light emitter 1, showing the cover part 4, the module 18 and the housing part 3. In contrast to the light emitter according to FIGS. 1 to 16, the light emitter according to the variation described here comprises the retaining device 36 and a feedthrough 12 arranged opposite thereto and located in particular on a common axis. The terminal part 7 of the module 18 when the module is inserted into the receptacle 9 is accessible from outside through the feedthrough 12. In contrast to the above-described example, in this variation the housing part 3 does not have a cut-out. The back of the module 18 is thus not visible from outside. A large-area heat distribution layer, for example, in the form of a Cu layer or Cu surface such as, for instance, a Cu foil, may thus be incorporated into the flexible conductor part 20. The conductor part may thus be of large-area construction and comprise an integral heat-conducting element. The conductor part 20 is conventionally not very aesthetically pleasing such that it is convenient to make the housing part 3 to be continuous and without cut-outs to keep the conductor part 20 invisible from outside.

As a result of the heat distribution over the large-area heat distribution layer in the conductor part 20, homogeneous luminance distribution over the radiation exit surface of the device 5 may be achieved. As in the other example, thermal contact elements 16 may be provided, but are not illustrated explicitly. The elements described further above, insofar as not otherwise explicitly described, may also be provided in this variation of the example. The heat distribution layer of the conductor part 20 may be connected thermally and optionally electrically conductively with a pole of the terminal part, for example, with the cathode. A degree of heat dissipation from the device when in operation may proceed such that via the terminal part 7 even if no thermal contact elements are provided.

The concept presented here may also be applied to other geometries of the device 5 with another contact layout. The jack plug may optionally even assume a mechanical retaining function when applied in the luminaire such that it is possible to dispense with additional retaining devices for the light emitter 1. The total weight of the light emitter may be 100 g or less, for example, 80 g or less, for instance 70 g. Such a weight may also be supported by a jack plug.

In operation, it is also not necessary to take account of any safety margins such as, for instance, air clearance and creepage distance in the range of protective extra-low voltage. In a series connection of a plurality of light sources 1, for example, via the electrical terminal parts 7 and 8, care should be taken to ensure that the protective extra-low voltage is not exceeded.

Through appropriate design of housing part 3 and cover part 4, the housing may be adapted to the cold state of the light emitter 1, i.e. that in which no radiation is emitted. The device may, for example, be configured to act in a reflective or diffusely reflective manner in the cold state. In this case the cover part and preferably the housing part may also be configured to be reflective or diffusely reflective. The complete light emitter may thus act as a uniform design element. Of course, it is optionally also possible for the respective elements of the light emitter 1 that are visible from outside to be of a different color.

A flexible conductor part 20 may optionally be omitted. This could be replaced by, for example, ultrasound-bonded wires, ribbon cables and/or plugs. This would avoid providing components adapted to the specific configuration of the device. However, manufacture, in particular assembly, would be more complicated. The flexible conductor part simplifies production of a compact module 18, which may also be replaced by the end consumer. It is optionally possible to dispense with the heat-conducting element.

Our light emitters are not restricted by the description given with reference to the examples. Rather, this disclosure encompasses any novel feature and any combination of features, even if the feature or combination is not itself explicitly indicated in the appended claims or examples.

The invention claimed is:

1. A light emitter with a radiation exit surface comprising:
a housing part with a receptacle,
at least one organic optoelectronic device arranged in the receptacle,
at least one cover part joined to the housing part, wherein the device is mounted between the cover part and the housing part, and
one or more external electrical terminal parts,
wherein
the device comprises a plurality of electrical contacts of the same polarity,
the contacts of the same polarity connect via a connecting conductor of a conductor part to a common external electrical terminal part, and
at least one of:
i. the conductor part connects electrically conductively to the device via an anisotropic electrically conductive layer, and
ii. the respective external electrical terminal part connects electrically conductively to the conductor part by solder.

2. A light emitter with a radiation exit surface comprising:
a housing part with a receptacle,
at least one organic optoelectronic device arranged in the receptacle,
at least one cover part joined to the housing part, and
a heat-conducting element is arranged on the device and connected thermally conductively to the device,
wherein the device is mounted between the cover part and the housing part,
the cover part comprises one or more thermal contact elements, via which the cover part connects thermally conductively to the device,
the heat-conducting element comprises a thermal land which, when viewed in plan view onto the radiation exit surface, is arranged next to the radiation exit surface, and
the thermal land connects thermally conductively to a thermal contact element of the cover part.

3. The light emitter according to claim 2, with a maximum thickness of 8 mm or less.

4. The light emitter according to claim 2, in which the cover part has a cut-out in a radiation passage region and in which the housing part has a cut-out in a region which overlaps with the radiation passage region.

5. The light emitter according to claim 2, in which the cover part is of magnetic construction and is detachably fastened to the housing part by magnetic force.

6. The light emitter according to claim 2, in which the respective external electrical terminal part is a connecting part for a jack plug connection.

7. The light emitter according to claim 2, in which the device comprises a plurality of electrical contacts of the same polarity, and the contacts of the same polarity connect via a connecting conductor of a conductor part to a common external electrical terminal part.

8. The light emitter according to claim 7, in which the conductor part connects electrically conductively to the device via an anisotropic electrically conductive layer.

9. The light emitter according to claim 7, in which the conductor part is a flexible printed circuit board.

10. The light emitter according to claim 7, in which the respective external electrical terminal part connects electrically conductively to the conductor part by solder.

11. The light emitter according to claim 2, in which the cover part comprises a fixing element designed and arranged to safeguard one of the external electrical terminal parts against movement relative to the housing part.

12. The light emitter according to claim 2, wherein the device comprises a plurality of electrical contacts of the same polarity, the contacts of the same polarity connect via a connecting conductor of a conductor part to a common external electrical terminal part, and the conductor part is a flexible printed circuit board.

13. The light emitter according to claim 12, wherein the flexible printed circuit board comprises a foil as printed circuit board conductor carrier.

14. The light emitter according to claim 12, wherein the foil comprises Kapton.

15. The light emitter according to claim 12, wherein the foil has a thickness of 350 μm or less.

16. A light emitter with a radiation exit surface comprising:

a housing part with a receptacle, at least one organic optoelectronic device, arranged in the receptacle, at least one cover part joined to the housing part, wherein the device is mounted between the cover part and the housing part, and one or more external electrical terminal parts having at least one of:

i. one terminal part of the terminal parts is a male connecting part of an electrical plug connection and another terminal part of the terminal parts is a female connecting part of an electrical plug connection, and ii. two terminal parts are oriented along an axis extending through the two terminal parts or the light emitter has a retaining device, and the retaining device and an electrical terminal part of the light emitter are oriented along a common axis extending through the retaining device and the terminal part, wherein the cover part comprises one or more thermal contact elements, via which the cover part connects thermally conductively to the device, a heat-conducting element is arranged on the device and connected thermally conductively to the device, the heat-conducting element comprises a thermal land which, when viewed in plan view onto the radiation exit surface, is arranged next to the radiation exit surface, and wherein the thermal land connects thermally conductively to a thermal contact element of the cover part.

* * * * *